US006676054B2

(12) United States Patent
Heaney et al.

(10) Patent No.: US 6,676,054 B2
(45) Date of Patent: Jan. 13, 2004

(54) UNWINDER FOR AS-SPUN ELASTOMERIC FIBER

(75) Inventors: Daniel J. Heaney, Neenah, WI (US); Jon P. Graverson, Needah, WI (US); Dennis Hicks, Neenah, WI (US); Kenneth E. Martin, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 14 days.

(21) Appl. No.: 10/100,811

(22) Filed: Mar. 19, 2002

(65) Prior Publication Data

US 2003/0006331 A1 Jan. 9, 2003

Related U.S. Application Data

(60) Provisional application No. 60/278,127, filed on Mar. 23, 2001.

(51) Int. Cl.[7] ..... B65H 49/02; B65H 20/20

(52) U.S. Cl. ..... 242/131; 242/128; 242/157 R; 242/418; 242/564.4; 242/593

(58) Field of Search ..... 242/131, 131.1, 242/128, 157 R, 418, 564.4, 566, 593

(56) References Cited

U.S. PATENT DOCUMENTS

| | | | | |
|---|---|---|---|---|
| 2,429,798 A | * | 10/1947 | Bradnack et al. | 242/131 |
| 3,642,218 A | * | 2/1972 | Furst | 242/418 |
| 3,797,767 A | | 3/1974 | Schippers et al. | |
| 3,999,715 A | | 12/1976 | Schippers et al. | |
| 4,471,917 A | * | 9/1984 | Whisnant | 242/131.1 |
| 4,610,402 A | * | 9/1986 | Corbett et al. | 242/157 R |
| 4,792,101 A | | 12/1988 | Van Bogaert et al. | |
| 5,172,734 A | * | 12/1992 | Matsui et al. | 139/450 |
| 5,624,082 A | * | 4/1997 | Ligon | 242/131 |
| 5,752,549 A | * | 5/1998 | Derudder et al. | 242/131.1 |
| 6,158,689 A | | 12/2000 | Mayer et al. | |

FOREIGN PATENT DOCUMENTS

| | | |
|---|---|---|
| DE | 3739175 A1 * | 6/1988 |
| GB | 1246318 | 9/1971 |

OTHER PUBLICATIONS

Research Disclosure, p. 728,730 Nov. 1995, Item #37922.

* cited by examiner

*Primary Examiner*—Michael R. Mansen

(57) ABSTRACT

An over-end takeoff device (OETO) and a method for unwinding elastomeric fiber from a package are provided. The OETO includes a fiber guide spaced apart from the fiber package and disposed at an acute angle between 0° and 30° to the rotational axis of the package.

10 Claims, 5 Drawing Sheets

UNWINDER FOR AS-SPUN ELASTOMERIC FIBER

BACKGROUND OF THE INVENTION

1. Field of the Invention

The present invention relates to a fiber unwinding device, and more specifically to a device that minimizes average tension levels and tension variations of a plurality of elastomeric fibers being transported to a downstream fiber processing operation.

2. Description of Background Art

The most common method of unwinding fiber from a cylindrical mandrel (or "package") in manufacturing processes is referred to as "rolling takeoff". When the package is exhausted the empty mandrel must be removed and a new package installed. This operation requires shutting down the manufacturing line causing unproductive downtime.

Another method often utilized, the over end takeoff (OETO) method, allows continuous operation, because the terminating end of the fiber wound on an active package can be attached to the leading end of the fiber wound on a standby package. This allows the active package to be fully exhausted at which point the standby package becomes the active package, all without any process interruption. However, unacceptable variations in threadline tension are common with OETO.

Research Disclosure, p. 729, November 1995, item #37922, discloses an OETO system in which elastomeric fiber is passed through a system comprising a relaxation section and motor driven nip rolls, before being fed to the manufacturing line. The relaxation section, extending between the package and the nip rolls, is stated to suppress tension variations. However, fibers that exhibit high cohesive forces (generally referred to as "tack") display unusually high variations in frictional forces and tension levels as the package unwinds. The slackness of the thread line in the relaxation region can vary and can result in temporarily excessive amounts of filament being unwound from the package. This excess fiber can be drawn into the nip rolls and wound up on itself leading to entanglement or breakage of the threadline requiring the manufacturing line to be stopped. The high level of tack contributes to the possibility of the excess fiber adhering to itself and to the nip rolls. The OETO device can also be configured such that the fiber horizontally traverses the relaxation section. In this case, the fiber then travels through nip rolls whose axes are vertical. However, in this configuration, the fiber in the region between the package and the nip rolls can sag. This sagging allows the threadline position on the nip rolls to become unstable and can result in interference between adjacent threadlines.

U.S. Pat. Nos. 3,797,767; 3,999,715 and 6,158,689 disclose the use of spirally grooved rolls in fiber winding machines in order to impart a specified pitch angle to a fiber as it is wound on a package. The use of grooved rolls for maintaining positional stability among a plurality of thread lines on a single roll is not described.

The aforementioned problems make the processing of high tack, elastomeric fibers particularly problematic. Fiber tack and its associated problems have been addressed by using topical fiber additives (prior to winding) or by unwinding the package and re-winding it on a new mandrel. However, both approaches add additional expense. Furthermore some applications (such as diaper manufacturing) require the use of as-spun fiber that is substantially finish-free and, consequently, exhibits high tack.

A fast and reliable method of removing high tack elastomeric fiber from a package is still needed.

SUMMARY OF THE INVENTION

Figure 1:
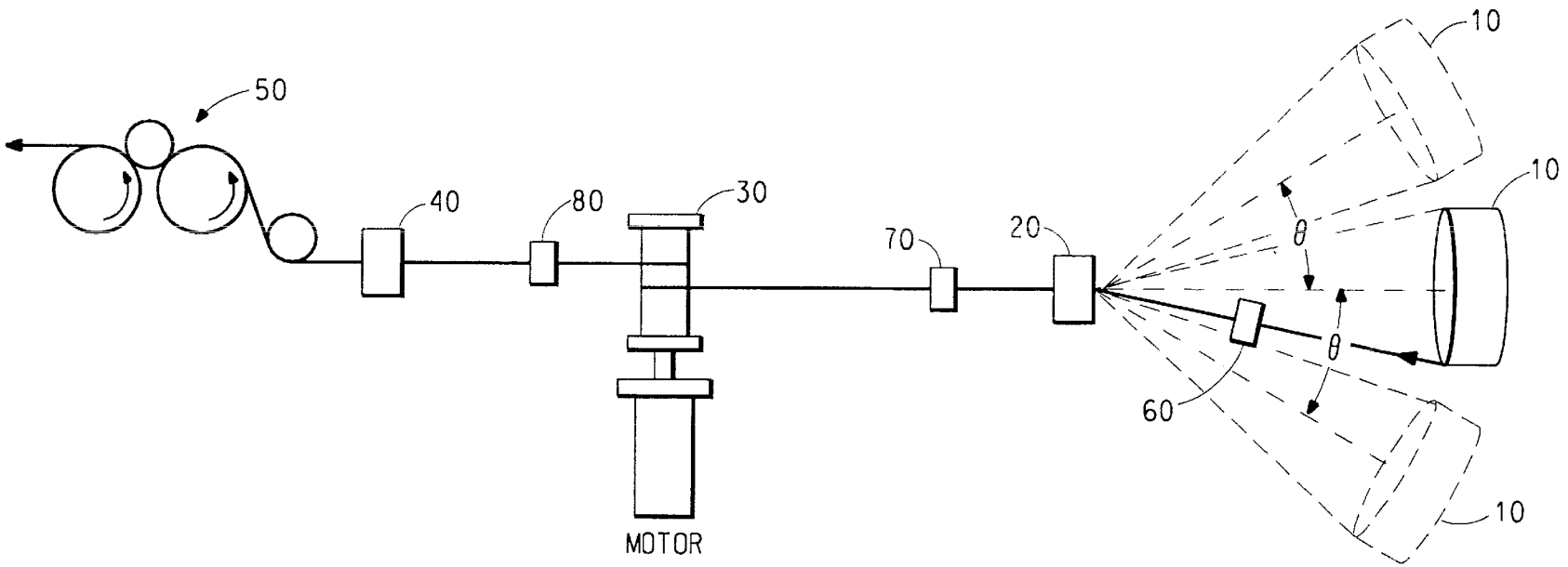
FIG. 1 schematically illustrates the fiber unwinding test equipment used to obtain the data in Examples 1–4.
Figure 2:
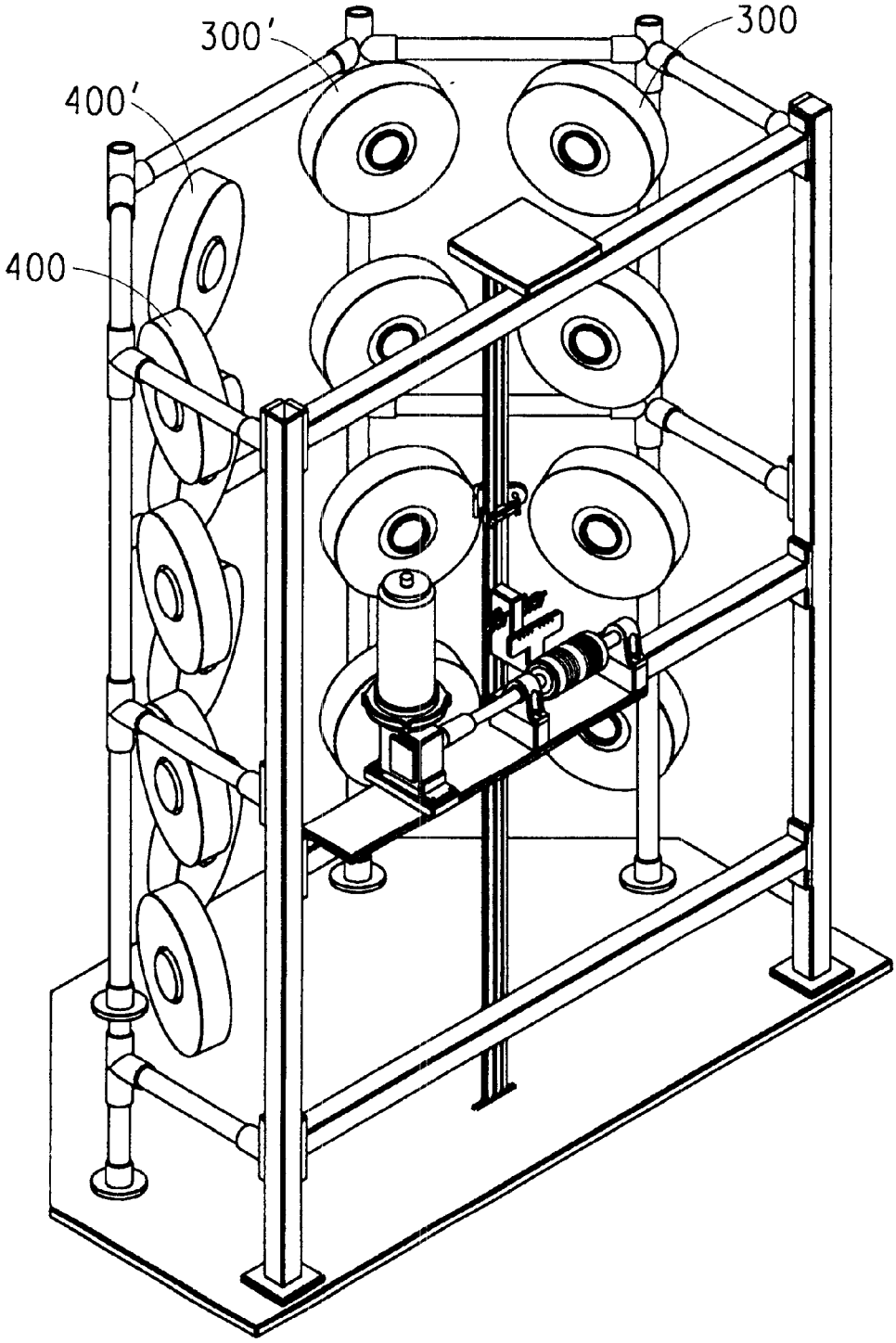
FIG. 2 shows a perspective drawing of a preferred embodiment of an OETO unwinding device.
Figure 3:
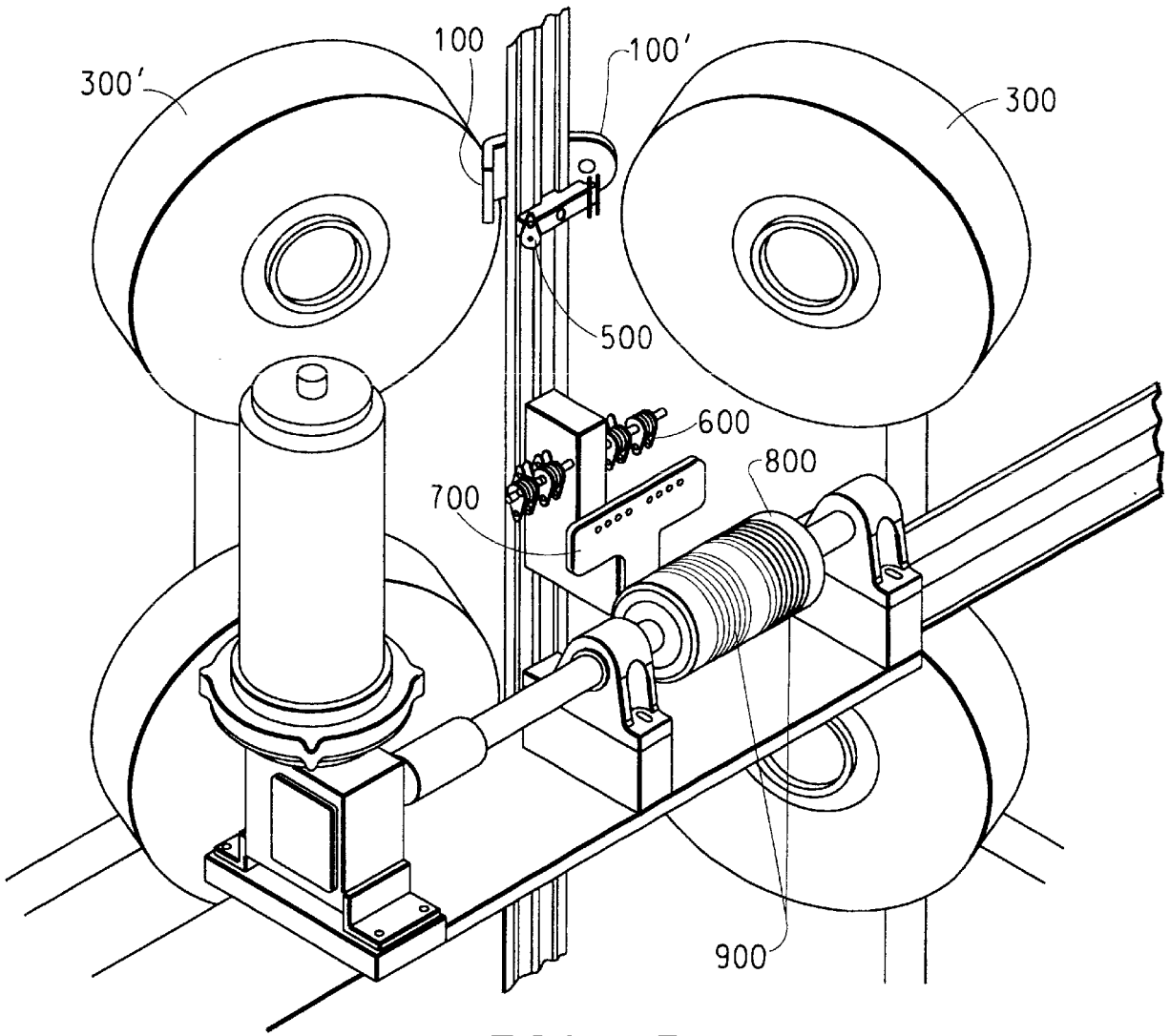
FIG. 3 illustrates a perspective view of a portion of an unwinding device of the invention including some of the packages, threadline guides and the first driven roll.

The present invention provides, in a first embodiment, an unwinder comprising a) a frame;

b) a fiber package holder affixed to said frame for holding a package of fiber about a rotational axis such that at least one fiber can unwind from said fiber package in a direction defining an acute angle with the rotational axis of the fiber package;

c) a driven take-off roll for unwinding fiber from the fiber package at a predetermined take-off rate:

d) a first fiber guide for directing fiber unwound from the fiber package towards the driven take-off roll, said first fiber guide positioned on said frame such that;

i. a distance (d) from the first fiber guide to the end of the fiber package facing such first fiber guide, measured on the line defined by the rotational axis of the fiber package, is equal to:

1) at least about 0.41 meter for fiber with tack of greater than about 2 grams OETO and less than about 7.5 grams OETO; or 2) from about 0.71 meter to about 0.91 meter for fiber with tack greater than about 7.5; and ii. an angle (θ), defined by the intersection of imaginary lines corresponding, respectively, to the rotational axis of the package and the central axis of the fiber guide inlet orifice is equal to:

1) 0° to about 30° for fibers with tack greater than about 2 grams OETO and less than about 7.5 grams OETO; or 2) 0° to about 10° for fibers with tack levels greater than about 7.5 grams OETO.

The unwinder of the invention may further include additional fiber guides between package and said take-off roll.

The unwinder of the invention preferrably further includes a second fiber guide positioned between the fiber package and the first fiber guide for directing fiber unwound from the fiber package. More preferrably, the unwinder of the invention further comprises a third fiber guide positioned between the first fiber guide and the driven take-off roll.

The unwinder of the invention may also include a fourth fiber guide positioned between the third fiber guide and the driven take-up roll.

At least one of the fiber guides may be a grooved roll or the driven take-off roll may be a grooved roll.

In a preferred embodiment, at least one fiber guide is a static circular guide having a wear-resistant surface for contacting the fiber. The circular fiber guide preferably has a wear-resistant inner surface such that the wear-resistant surface is the inner surface of an annulus.

In a second embodiment, the invention provides a method for unwinding fiber comprising the steps of:

a. holding a fiber package about a rotational axis such that at least one fiber can unwind from the fiber package in a direction defining an acute angle with the rotational axis of the fiber package;

b. unwinding fiber from the fiber package of step (a) at a controlled predetermined rate;

c. controlling the direction of said fiber of step (a) by passing the fiber through a first fiber guide; and d. controlling the distance (d) from said first fiber guide to the end of said fiber package facing said fiber fiber guide, measured on the line defined by the rotational axis of the fiber package, such that said distance (d) is equal to:

i. at least about 0.41 meter for fiber with tack of greater than about 2 grams OETO and less than about 7.5 grams OETO; or ii. from about 0.71 meter to about 0.91 meter for fiber with tack greater than about 7.5;

e. controlling an angle (θ), defined by the intersection of imaginary lines corresponding, respectively, to the rotational axis of the package and the central axis of said first fiber guide that is perpendicular to the plane of the orifice, such that said angle (θ) is equal to:

i. 0° to about 30° for fibers with tack greater than about 2 grams OETO and less than about 7.5 grams OETO; or ii. 0° to about 10° for fibers with tack levels greater than about 7.5 grams OETO.

DETAILED DESCRIPTION OF THE INVENTION

With reference to FIG. 1, a fiber package 10 is maintained in a desired orientation by a cylindrical rod (not shown). The diameter of the rod is smaller than the diameter of the open core of the package such that the package can be slid over the suitably positioned rod and such that the fiber can be unwound from the package by over end takeoff. The fiber is then directed, in sequence, through a static guide 20 having a substantially circular orifice; a driven roll 30 around which the fiber is wrapped 360°, or less; and a second, driven take-up roll or set of rolls 50. The static guide is typically an orifice whose inner surface can be a highly polished ceramic material. Such a surface can provide excellent wear resistance and low friction. The take-up roll or rolls 50 representing that part of the manufacturing process equipment to which the fiber is being supplied, is/are rotated at a speed relatively higher than the first motor-driven roll, so as to provide the desired draft. A distance (d) between the package and the static guide, which is at least about 0.43 meter and preferably not more than about 0.91 meter, can be maintained for operation with high tack fibers. An acute angle (θ), defined by the intersection of the imaginary lines corresponding, respectively, to the rotational axis of the package and the central axis of the static guide orifice that is perpendicular to the plane of the orifice, is preferably maintained between 0 and about 30° for operation with high tack fibers. Means for stabilizing the position of the threadline on the first driven roll can be provided by, for example, use of one or more additional guides 60, 70, 80 and/or a plurality of grooves in the surface of the first driven roll 30 wherein said grooves are substantially perpendicular to the roll axis and substantially parallel to the direction of travel of the threadline.

Distances less than 0.41 meter can result in undesirably large tension variations. These variations can cause process control difficulties and can also lead to thread line breakages. Distances longer than 0.91 meter make the unwinding equipment less compact and ergonometrically less favorable. As the level of tack exhibited by the fiber increases, the minimum allowable distance, d, increases. For fibers with tack levels greater than about 2 and less than about 7.5, d is preferably at least about 0.41 meter; and for fibers with tack levels greater than about 7.5, d is preferably at least about 0.71 meter.

As the level of tack exhibited by the fiber increases, the maximum allowable angle, θ, decreases. The directional change of the threadline, as it passes through the first static guide, as measured in terms of θ, is preferably limited to between 0° and about 30° for fibers with tack levels greater than about 2 and less than about 7.5, and between 0° and about 10° for fibers with tack levels greater than about 7.5. Larger angles can result in excessive variations in thread line tension and draft, or even threadline breakage.

The desired thread line positional stability can be assured by providing grooves in the surface of the first driven roll. Such grooves also allow closer spacing of the threadlines, thereby minimizing the dimensions of the equipment. The resulting stability of the threadline position also allows operator intervention to correct a threadline problem, while the process is running, with less risk of disturbing adjacent thread lines.

Threadline guides can be used in addition to, or instead of, grooved rolls to impart thread line stability and to direct the threadline along a desired path. Of the various threadline guides available, captive, rolling guides are preferred. The use of a single, first motor-driven roll described above is found to give outstanding process performance without the need for employing the more mechanically complex and expensive nip rolls described in Research Disclosure, item 37922, cited above. A wrap of 360° or less of the thread line around the roll minimizes fiber-on-fiber contact and the possibility of fiber damage associated with such contact. Less than 360° contact between the thread line and roll can be achieved by the appropriate positioning of a threadline guide placed immediately after the roll to lift the fiber off the roll surface short of a complete 360° wrap.

The process by which the unwinder of this invention can be operated involves the following steps, with reference to FIGS. 2, 3, 4, 5A and 5B: a) placing the fiber packages on their respective mounting rods; b) tying the leading end of fiber from each standby package 300' or 400' to the trailing fiber end of its corresponding active package 300 or 400, respectively; c) directing the leading fiber end of each active package through its respective static guide 100 or 100', then through a wrap of 360° or less around the first driven roll 800 and then causing it to be engaged by a take-up device not shown in FIGS. 2–5 (identified as 50 in FIG. 1) (this device, typically a driven roll or set of driven rolls, represents that element of the manufacturing process which first engages the fiber as it exits the unwinder); d) initiating rotation of the first driven roll 800 and take-up device (not shown); while e) controlling the surface speeds of each such that the surface speed of roll/s (not shown) exceeds that of roll 800 by the percentage corresponding to the desired fiber elongation (or draft); f) replacing each active package 300 or 400, as it becomes exhausted, with what now becomes a standby package; and g) tying the leading fiber end of this new standby package 300 or 400 with the trailing end of the now, active package 300' or 400'. Repeating steps f and g (or b), as required, allows uninterrupted operation. As previously described, positional stabilization of the threadlines can be achieved by the use of a grooved roll 800, and/or additional threadline guides. In the event that a grooved roll is employed, step c, above, also includes placing each fiber in its corresponding groove. In the event that additional threadline guides are employed, additional steps must be added to the above procedure to thread each fiber through its respective, additional guides in the sequence that such guides are encountered.

FIGS. 2–5A&B illustrate a preferred embodiment of an OETO unwinding device for high tack spandex fiber. For the purpose of improved clarity, the threadlines are not shown. As presented in FIGS. 2, 3 and 4, the OETO fiber unwinding system has the capacity to feed a manufacturing line with eight (8) threadlines, requiring a capacity to accommodate sixteen (16) packages. Each threadline supplied from an active package to the first, static guide 100 or 100' is kept in the horizontal plane. The packages are mounted in vertical tiers 200, each tier holding four (4) packages 300, 300', 400 and 400'. The four packages are arranged in pairs, each pair consisting of one active 300 or 400 and one standby 300' or 400' package.

Figure 4:
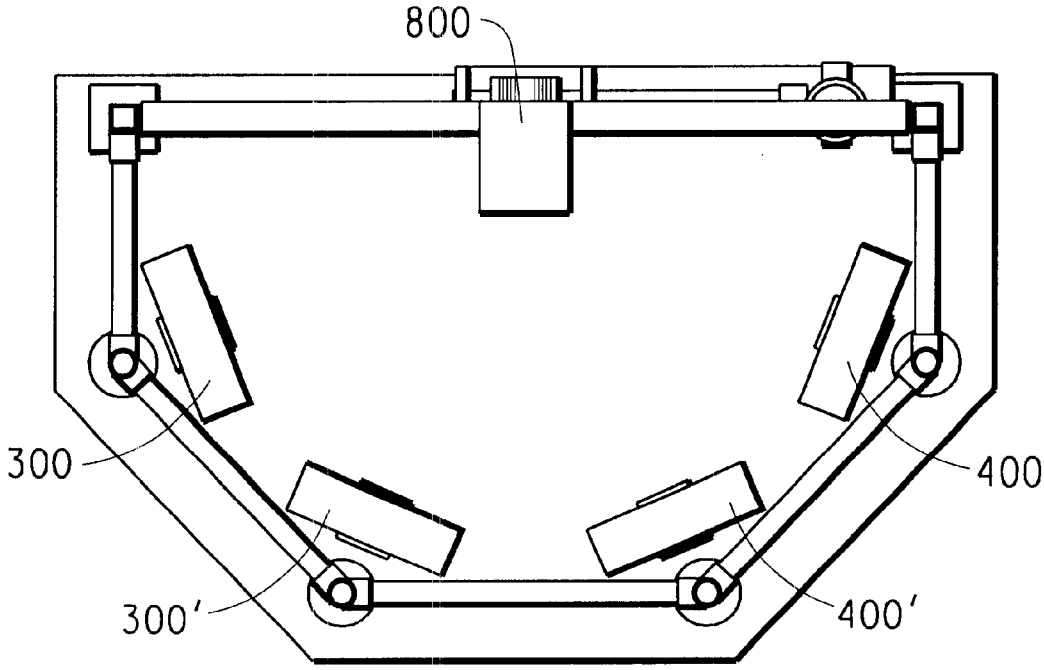
FIG. 4 is a top view of an unwinding device of the invention.
Figure 5B:
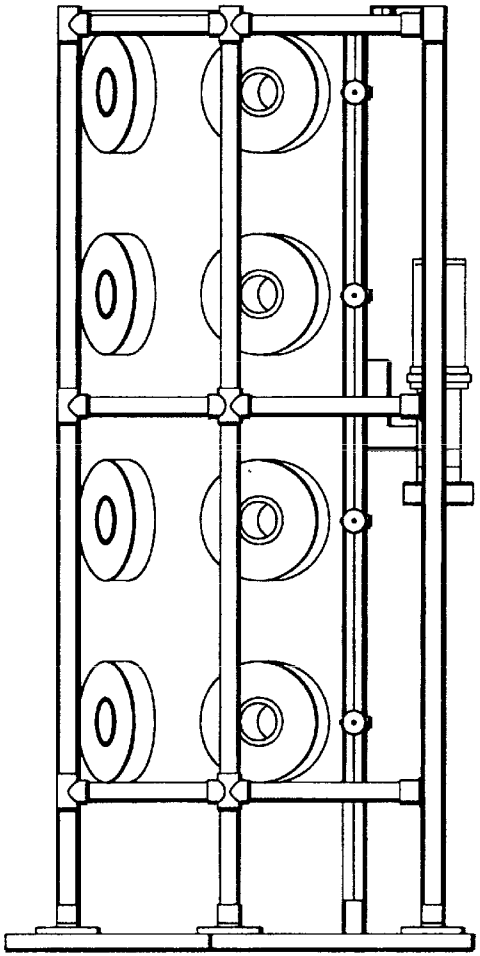
FIGS. 5A and 5B, are back and side views, respectively, of an unwinding device of the invention.
Figure 5A:
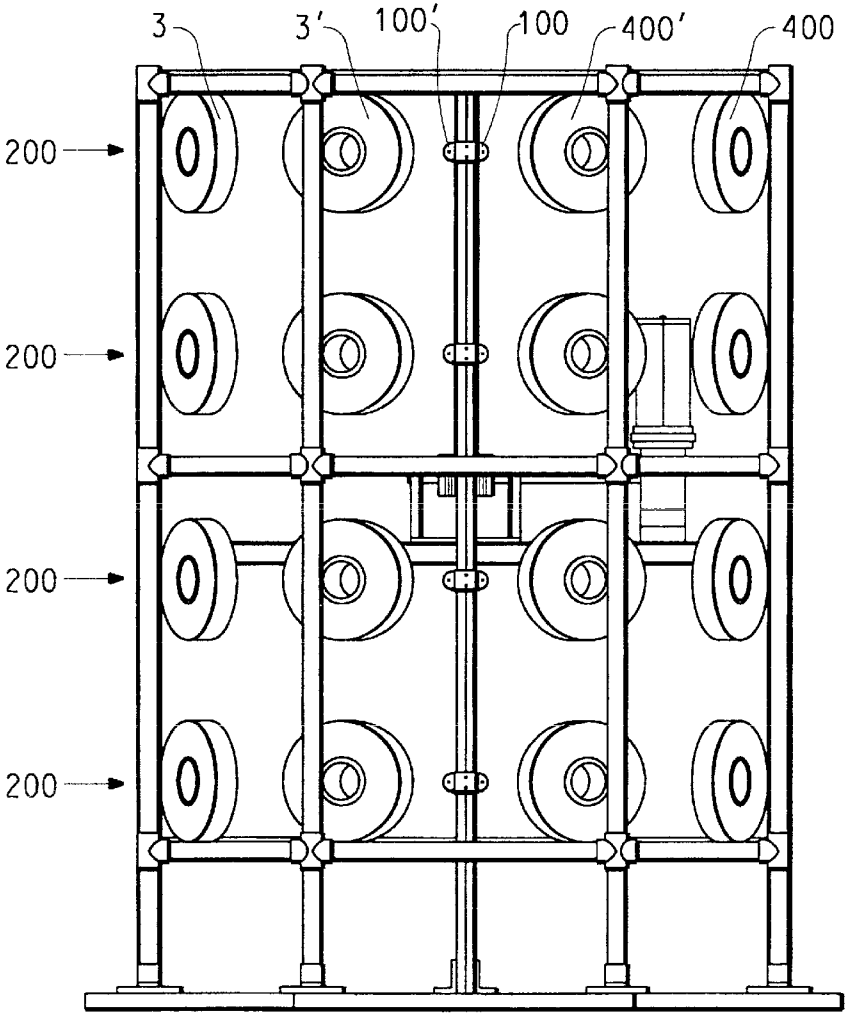

With reference to FIGS. 4, 5A and 5B, each threadline leads from an active package 300 or 400 through a first static guide 100 or 100' and then through a captive rolling guide 500, at the horizontal center of the unwinding device. All three of these elements are located substantially on the same horizontal plane.

Referring to FIG. 5A, the threadline is then turned up or down, depending upon the tier from which it originated, to the vertical center of the unwinding device. At the vertical center of the unwinding device, each threadlines is fed through its respective captive rolling guide 600 and then directed horizontally through its respective static guide 700. Finally, the threadlines are wrapped 360°, or less, around a horizontal driven roll 800. The driven roll 800 (shown in FIG. 3) is illustrated with eight grooves 900, through which the threadlines run. The groove depths are 0.38 mm and the spacing between the grooves is 15 mm. Grooves are an optional feature of horizontal driven roll 800; the driven roll may alternatively have a smooth surface.

The following examples include experiments with Lycra® XA® fibers having no topically applied finish.

EXAMPLE 1

The test equipment used in obtaining the data for this and the following examples, could be configured in various ways, such as optionally including or excluding certain design elements and changing the sequence of certain elements. The equipment configuration employed for this example, with reference to FIG. 1, was comprised of the following elements, listed in the order in which they were encountered by the moving threadline: fiber package 10, static guide 20, first, driven roll 30, tension sensor 40, and driven take-up rolls 50.

The test equipment geometry and other experimental test conditions are summarized below:

The distances between the static guide and the first driven roll, between the first driven roll and the tension sensor and between the first driven roll and the take-up roll were 0.22, 1.94 and 2.1–3.4 meters, respectively. In this example, the first driven roll, having a diameter of 8.89 cm., was not grooved. The threadline was maintained in the horizontal plane (relative to ground), and its directional change within that horizontal plane as it passed through the static guide, was maintained constant at 0° θ. The distance between the package and first guide was varied. The threadline was wrapped 360° around the first driven roll. The threadline draft was controlled at 2.15× by maintaining the surface speeds of the first roll at 93.4 meter/min, and the surface speed of the takeup rolls at 294.3 meters/min.

Tension data (expressed in grams) were collected with a Model PDM-8 data logger, and a Model TE-200-C-CE-DC sensor (Electromatic Equipment Co.). All tension measurements were averaged over five-minute run time using a data sampling frequency of approximately 82 samples/sec.

"Mean range tension" was determined as follows: within every 1.25-second interval of the tension measurement, the minimum and maximum tension levels were recorded (yielding 103 data points). Mean range tension was calculated by averaging the differences (between the minimum and maximum values) over the 5-min run.

The fiber evaluated in this test was as-spun Lycra® XA spandex (a registered trademark of E.I. du Pont de Nemours and Company) having a linear density of 620 dtex (decigram per kilometer).

Table 1 shows the thread line tension variations, as measured at the sensor, as the distance, d, between the package and the static guide was varied over a distance between about 0.25 and 0.81 meter.

TABLE 1

| Distance (meter) | Mean Range Tension (grams) | Max. Tension (grams) |
|---|---|---|
| 0.27 | 16.90 | 50.00 |
| 0.28 | 17.60 | 50.00 |
| 0.30 | 17.80 | 50.00 |
| 0.33 | 16.30 | 50.00 |
| 0.36 | 16.30 | 49.00 |
| 0.38 | 14.50 | 50.00 |
| 0.41 | 13.70 | 48.40 |
| 0.43 | 13.30 | 38.00 |
| 0.46 | 12.40 | 37.10 |
| 0.48 | 12.20 | 44.70 |
| 0.51 | 11.60 | 36.30 |
| 0.53 | 11.60 | 36.70 |
| 0.56 | 11.60 | 30.40 |
| 0.58 | 11.80 | 32.60 |
| 0.61 | 10.00 | 28.80 |
| 0.64 | 10.60 | 34.30 |
| 0.66 | 10.60 | 25.30 |
| 0.69 | 10.40 | 34.30 |
| 0.71 | 10.60 | 29.80 |
| 0.74 | 10.00 | 28.40 |
| 0.76 | 10.40 | 29.40 |
| 0.79 | 10.80 | 27.80 |
| 0.80 | 10.80 | 34.50 |

Table 1 demonstrates that thread line tension (expressed either as the mean range or the maximum tension) decreases as the distance between the package and the static guide is increased. Minimum tensions, not shown in the table ranged from about 0.6 to 1.4 grams. Unexpectedly, it has been discovered that there is a minimum distance of about 0.41 meter below which the absolute level of tension and the tension variability (as observed by plotting, for example, maximum tension versus distance) rises to an unacceptably high level identifiable by the occurrence of threadline breakages which are usually preceded by a relatively abrupt increase in mean range tension.

EXAMPLE 2

The same test equipment as described in Example 1, but configured to more closely correspond to the preferred embodiment of the OETO unwinder design was utilized. With reference to FIG. 1, the equipment had the following elements in the order in which they were encountered by the moving threadline: fiber package 10, captive rolling guide 60, static guide 20, captive rolling guide 70, first, driven roll 30, captive rolling guide 80, tension sensor 40, and driven take-up rolls 50.

The distances between the static guide and the first driven roll, between the first driven roll and the tension sensor, and between the first driven roll and the takeup rolls were 0.43, 0.51 and 2.43 meters, respectively. The first driven roll was a single roll having a single groove with a depth of 0.38 mm. The threadline was again maintained in the horizontal plane. The distance between the package and the static guide was held constant at 0.65 meter while the angle, θ, was varied. Threadline draft was maintained at 4× by controlling the first driven roll and the takeup rolls, respectively, at surface speeds of 68.6 and 274.3 meters/min.

In addition to monitoring threadline tension as in Example 1, tension spikes were also recorded. "Tension spikes" are the average number of sudden increases in tension greater than 25 grams above baseline tension in a 5-min period.

Various as-spun Lycra® XA® spandex fibers, exhibiting different levels of tack, were evaluated. Tack levels were characterized by measuring the OETO tension (in grams) by the following method: The fiber package and a ceramic pig tail guide were mounted 0.61 meter apart, such that the axes of each were directly in line. The fiber is pulled off the package over end at a threadline speed of 50 meters/min, through the guide, and through a tension sensor.

Table 2 shows the threadline tension variations as the angle θ increased; where θ is defined as the acute angle made by the intersection of the imaginary lines corresponding, respectively, to the rotational axis of the package and the central axis of the static guide orifice that is perpendicular to the plane of the orifice.

TABLE 2

| Fiber | Angle (degree) | Mean Range Tension (g) | Max. Tension (grams) | Tension Spikes | Tack |
|---|---|---|---|---|---|
| T-127 | 0 | 38.4 | 174.9 | 56 | |
| 620 dtex | 5 | 40.8 | 176.5 | 85 | |
| Lot 9291 | 11 | BROKE | | | |
| Merge 1Y331 | 22 | BROKE | | | |
| | 45 | BROKE | | | |
| T-127 | 0 | 16.5 | 118.4 | 0 | |
| 620 dtex | 5 | 17.3 | 119.2 | 0 | |
| Lot 0211 | 11 | 17.3 | 122.4 | 0 | |
| Merge 16398 | 22 | 18.8 | 124.7 | 0 | |
| | 45 | 20.4 | 131.8 | 0 | |
| | 57 | 25.1 | 138.0 | 1 | |
| | 67 | 29.0 | 149.0 | 9 | |
| | 77 | 30.6 | 156.9 | 11 | |
| | 90 | 35.3 | 167.9 | 14 | |
| T-162B | 22 | 32.9 | 171.8 | 16 | 11.368 |
| 800 dtex | 45 | 40.8 | 198.4 | 53 | " |
| Lot 0205 | 57 | 44.7 | >200 | 72 | " |
| Merge 16525 | | | | | |
| T-162C | 22 | 25.9 | 159.2 | 0 | 7.02 |
| 800 dtex | 45 | 29.8 | 176.5 | 4 | " |
| Lot 0020 | 57 | 31.4 | 169.4 | 24 | " |
| Merge 16600 | | | | | |

Examination of the data in the above table reveals an unexpected relationship between threadline tension and the angle between the centerlines of the package and the static guide. As the angle increases so does thread line tension, and tension spikes occur more frequently. At sufficiently large angles, thread line breakage can occur. The sensitivity of tread line tension to the angle traversed by the thread line as it passes through the guide is dependent upon the properties of the fiber. The data of Table 2 indicates that fibers characterized by higher tack exhibit higher sensitivity of thread line tension with respect to this angle. For some fibers that exhibit an exceptionally high level of tack, the angle above which thread line breakage cannot be avoided is less than about 10°.

EXAMPLE 3

This series of runs, using the test equipment described previously and configured as in Example 2, evaluated the effect of angle on threadline tension for fibers of different tack levels. The distance, d, between the package and the static guide was maintained constant at 0.65 meter. Threadline draft was maintained at 4× by controlling the first driven roll and the takeup rolls, respectively, at surface speeds of 68.6 and 274.3 meters/min. All other experimental conditions were as described for Example 2. The data are summarized in Table 3.

TABLE 3

| Fiber | Angle (decree) | Mean Range Tension (g) | Max. Tension (grams) | Tension Spikes | Tack |
|---|---|---|---|---|---|
| T-162 C | 0 | 25.1 | 164.7 | 2 | 7.02 |
| 800 dtex | 5 | 25.1 | 157.7 | 0 | " |
| Merge 16600 | 11 | 27.5 | 156.9 | 0 | " |
| Lot 0020 | 22 | 28.2 | 160.0 | 0 | " |
| | 45 | 36.9 | 182.8 | 16 | " |
| | 57 | 42.4 | 196.1 | 59 | " |
| | 67 | 47.8 | >200.0 | 127 | " |
| | 77 | BROKE | | | |
| T-162C | 0 | 18.0 | 150.6 | 0 | 1.408 |
| As-spun | 5 | 15.7 | 142.8 | 0 | " |
| 840 den | 11 | 17.3 | 143.5 | 0 | " |
| Merge 16795 | 22 | 14.9 | 140.4 | 0 | " |
| Lot 1019 | 45 | 14.9 | 138.8 | 0 | " |
| | 57 | | | | " |
| | 67 | 15.7 | 140.4 | 0 | " |
| | 77 | 16.5 | 144.3 | 0 | " |
| | 90 | 17.3 | 145.1 | 0 | " |
| T-162 B | 0 | 29.0 | 171.8 | 13 | 11.368 |
| 800 dtex | 5 | 32.2 | 172.6 | 10 | " |
| Merge 16525 | 11 | 36.1 | 184.3 | 42 | " |
| Lot 0205 | 22 | 39.2 | >200.0 | 43 | " |
| | 45 | 52.6 | >200.0 | 126 | " |
| | 57 | BROKE | | | " |

The high tack fibers tested in this series of runs are the same as two of the fibers tested in Example 2. Comparison of the data for these same fibers in Tables 2 and 3, shows that thread line tension increases with increasing angle, and thread line breakage may occur at excessively high angles. (In contrast, fibers containing finish can be run at angles of up to and including 90° with no increase in thread line tension, no occurrence of tension spikes and no thread line breaks. When Lycra®XA® T-162C fiber, 924 dtex den, merge 16795(lot 1019), finish, having a tack of 1.406, was run at angles of 0–90°, there was no threadline tension increase and no tension spikes.)

These data demonstrate that limiting the angle the thread line traverses as it passes through the first static guide provides uninterrupted manufacturing processing even for high tack fiber threadlines.

EXAMPLE 4

This series of runs using the test equipment described previously and configured as in Example 2, evaluated the effect of the distance, d, between the package and the static guide on threadline tension for fibers of different tack levels. The angle, θ, was maintained constant at 22°. The threadline draft was controlled at 4× and the take-up speed at 274.3 meters/min.

TABLE 4

| Fiber | Distance (meter) | Mean Range Tension (g) | Max. Tension (grams) | Tack (grams) |
|---|---|---|---|---|
| T-162 C | 0.20 | 56.5 | >200 | 7.02 |
| As-spun | 0.30 | 44.7 | 200.0 | " |
| 720 den | 0.41 | 32.2 | 182.0 | " |
| Merge 16600 | 0.51 | 32.2 | 174.9 | " |
| Lot 0020 | 0.61 | 31.4 | 181.2 | " |
| | 0.71 | 29.0 | 173.3 | " |
| | 0.81 | 29.8 | 178.8 | " |
| | 0.91 | 32.2 | 173.3 | " |
| | 1.02 | 29.0 | 167.9 | " |
| T-162 B | 0.20 | BROKE | BROKE | 11.368 |
| As-spun | 0.30 | 57.3 | >200 | " |
| 720 den | 0.41 | 56.5 | >200 | " |
| Merge 16525 | 0.51 | 55.7 | >200 | " |
| Lot 0205 | 0.61 | 56.5 | 200.0 | " |
| | 0.71 | 56.5 | 200.0 | " |
| | 0.81 | 48.6 | 200.0 | " |
| | 0.91 | 50.2 | 200.0 | " |
| | 1.02 | 52.6 | 200.0 | " |

The test results for these fibers show the minimum distance between the package and the fixed guide below which the threadline tension and mean range tension increase unacceptably. The value of this minimum depends upon the tack level of the fiber being tested. In contrast, there is essentially no effect of package-to-static guide distance on the lower tack Lycra® spandex. These results reinforce the difficulty in maintaining smoothly running process conditions with high tack fibers. The present invention allows successful control of processes utilizing such fibers.

EXAMPLE 5

A test of the operation of the unwinder system of this invention, as pictured in FIGS. 2–5, was conducted under commercial production conditions using fibers that were characterized by different levels of tack. Table 5 summarizes these test results. Data were obtained as in previous examples, except that each of the tension measurements reported is the average of a minimum of 4 separate measurements, each measurement consisting of one tube running for a 10-min period. Similarly, each number of tension spikes, as reported in Table 5, is the average number of spikes greater than 25 grams above baseline tension in a 10-min period. Measurements were made on packages that were nearly full (surface) or nearly empty (core). Core measurements are those with about 1.6-cm thickness of yarn remaining on the tube. Of the 5 as-spun fibers run, 4 ran with no operational problems. One fiber sample, Merge 1Y331, did result in an unacceptable occurrence of tension spikes. That fiber demonstrated an unusually high level of tack, even for as-spun fiber, as evidenced by the fact that the mean range tension was over 60% higher than that of the fiber exhibiting the next highest level of tack.

TABLE 5

| Fiber | Linear Density (dtex) | Location on Tube | Yarn Speed (ft/min) | Yarn Draft | Mean Range Tension (grams) | Max. Tension (grams) | Tension Spikes |
|---|---|---|---|---|---|---|---|
| Merge 16398 | 620 | Surface | 274.3 | 4X | 12.3 | 100.6 | 0 |
| Merge 16398 | 620 | Surface | 121.9 | 4X | 12.5 | 96.1 | 0 |
| Merge 16398 | 620 | Core | 274.3 | 4X | 17.5 | 110.7 | 0 |
| Merge 16398 | 620 | Core | 121.9 | 4X | 16.3 | 104.1 | 0 |
| Merge 1Y331 | 620 | Surface | 274.3 | 4X | 28.6 | 151.4 | 18 |

What is claimed is:

1. An unwinder comprising:

a) a frame;

b) a fiber package holder affixed to said frame;

c) a fiber package held on the fiber package holder about a rotational axis such that at least one fiber can unwind from said fiber package in a direction defining an acute angle with the rotational axis of the fiber package;

d) a driven take-off roll for unwinding said at least one fiber from the fiber package at a predetermined take-off rate:

e) a first fiber guide for directing said at least one fiber as said at least one fiber is unwound from the fiber package, said first fiber guide defining a fiber guide inlet orifice having a central axis and positioned on said frame such that;

i. a distance (d) from the first fiber guide to a front end of the fiber package facing said first fiber guide, measured on the line defined by the rotational axis of the fiber package, is equal to:

1) at least about 0.41 meter when said at least one fiber has tack greater than about 2 grams OETO and less than about 7.5 grams OETO; or 2) from about 0.71 meter to about 0.91 meter when said at least one fiber has tack greater than about 7.5;

ii. an angle (θ), defined by the intersection of imaginary lines corresponding, respectively, to the rotational axis of the package and the central axis of the fiber guide inlet orifice that is equal to:

1) 0° to about 30° when said at least one fiber has tack greater than about 2 grams OETO and less than about 7.5 grams OETO; or 2) 0° to about 10° when said at least one fiber has tack greater than about 7.5 grams CETO.

2. The unwinder of claim 1 further comprising a second fiber guide positioned between said fiber package and said first fiber guide for directing said at least one fiber as said at least one fiber is unwound from the fiber package.

3. The unwinder of claim 2 further comprising a third fiber guide positioned between said first fiber guide and said driven take-off roll.

4. The unwinder of claim 3 further comprising a fourth fiber guide positioned between said third fiber guide and said driven take-off roll.

5. The unwinder of claim 1 wherein said first fiber guide comprises a grooved roll.

6. The unwinder of claim 1 wherein said first fiber guide comprises a circular guide having a wear-resistant surface for contacting the fiber.

7. The unwinder of claim 6 wherein said wear-resistant surface is the inner surface of an annulus.

8. The unwinder of claim 1 wherein said first fiber guide is a static guide.

9. A method for unwinding fiber from a fiber package comprising the steps of:

a. holding the fiber package about a rotational axis such that at least one fiber can unwind from the fiber package in a direction defining an acute angle with the rotational axis of the fiber package;

b. unwinding said at least one fiber from the fiber package at a controlled predetermined rate;

c. controlling the direction of said at least one fiber by passing said at least one fiber through a first static fiber guide having an orifice with a central axis that is perpendicular to the plane of the orifice; and d. establishing the distance (d) from said first static fiber guide to a front end of said fiber package facing said fiber guide, measured on the line defined by the rotational axis of the fiber package, such that said distance (d) is equal to:

i. at least about 0.41 meter when said at least one fiber has tack greater than about 2 grams OETO and less than about 7.5 grams OETO; or ii. from about 0.71 meter to about 0.91 meter when said at least one fiber has tack greater than about 7.5;

e. setting an angle (θ), defined by the intersection of imaginary lines corresponding, respectively, to the rotational axis of the package and the central axis of said first fiber guide such that said angle (θ) is equal to:

i. 0° to about 30° when said at least one fiber has tack greater than about 2 grams OETO and less than about 7.5 grams OETO; or ii. 0° to about 10° when said at least one fiber has tack greater than about 7.5 grams OETO.

10. The method of claim 9 further comprising providing a second fiber guide positioned between said fiber package and said first static fiber guide for directing said at least one fiber as said at least one fiber is unwound from the fiber package.

* * * * *